US009200575B2

(12) United States Patent
Shost

(10) Patent No.: US 9,200,575 B2
(45) Date of Patent: Dec. 1, 2015

(54) MANAGING ENGINE FIRING PATTERNS AND PATTERN TRANSITIONS DURING SKIP FIRE ENGINE OPERATION

(71) Applicant: Tula Technology Inc., San Jose, CA (US)

(72) Inventor: Mark A. Shost, Northville, MI (US)

(73) Assignee: Tula Technology, Inc., San Jose, CA (US)

( * ) Notice: Subject to any disclaimer, the term of this patent is extended or adjusted under 35 U.S.C. 154(b) by 116 days.

(21) Appl. No.: 14/203,444

(22) Filed: Mar. 10, 2014

(65) Prior Publication Data

US 2014/0261316 A1 Sep. 18, 2014

Related U.S. Application Data

(60) Provisional application No. 61/801,472, filed on Mar. 15, 2013.

(51) Int. Cl.
*F02D 17/02* (2006.01)

(52) U.S. Cl.
CPC ..... *F02D 17/02* (2013.01)

(58) Field of Classification Search
CPC ..... F02D 17/00; F02D 17/02; F02D 37/02; F02D 41/00; F02D 41/0087; F02D 2041/2027; F02D 2250/18; Y02T 10/44; Y02T 10/46
USPC ..... 123/305, 349, 350, 478, 480, 481, 620, 123/406.11, 406.12, 406.19, 406.23, 198 F; 701/102–105, 112
See application file for complete search history.

(56) References Cited

U.S. PATENT DOCUMENTS

| | | | |
|---|---|---|---|
| 2,875,742 | A | 3/1959 | Dolza |
| 4,064,844 | A | 12/1977 | Matsumoto et al. |
| 4,129,109 | A | 12/1978 | Matsumoto et al. |
| 4,172,434 | A | 10/1979 | Coles |
| 4,274,382 | A | 6/1981 | Sugasawa et al. |
| 4,276,863 | A | 7/1981 | Sugasawa et al. |
| 4,434,767 | A | 3/1984 | Kohama et al. |
| 4,489,695 | A | 12/1984 | Kohama et al. |
| 4,509,488 | A | 4/1985 | Forster et al. |
| 5,117,790 | A | 6/1992 | Clarke et al. |
| 5,377,631 | A | 1/1995 | Schechter |
| 5,408,966 | A | 4/1995 | Lipinski et al. |

(Continued)

OTHER PUBLICATIONS

International Search Report dated Jul. 1, 2014 from International Application No. PCT/US2014/024776.

(Continued)

*Primary Examiner* — John Kwon
*Assistant Examiner* — Johnny H Hoang
(74) *Attorney, Agent, or Firm* — Beyer Law Group LLP

(57) ABSTRACT

Various methods and data structures for managing transition between different firing fractions during skip fire operation of an engine are described. In some embodiments, transitions are constrained to occur when firing sequence segments of a designated length are shared by the first and second firing fractions. In a separate aspect, a data structure that uses current firing fraction phase as a first index and a target firing fraction as a second index may be used to determine a phase of the target firing fraction to enter at a transition. Is some circumstances transitions between a current and target firing fraction may be conducted as a series of steps through intermediate firing fractions.

21 Claims, 8 Drawing Sheets

(56) References Cited

U.S. PATENT DOCUMENTS

| | | | |
|---|---|---|---|
| 5,408,974 | A | 4/1995 | Lipinski et al. |
| 5,540,633 | A | 7/1996 | Yamanaka et al. |
| 5,690,073 | A | 11/1997 | Fuwa |
| 5,720,257 | A | 2/1998 | Motose et al. |
| 5,778,858 | A | 7/1998 | Garabedian |
| 5,975,052 | A | 11/1999 | Moyer |
| 6,158,411 | A | 12/2000 | Morikawa |
| 6,408,625 | B1 | 6/2002 | Woon et al. |
| 6,619,258 | B2 | 9/2003 | McKay et al. |
| 7,063,062 | B2 | 6/2006 | Lewis et al. |
| 7,086,386 | B2 | 8/2006 | Doering |
| 7,503,312 | B2 | 3/2009 | Surnilla et al. |
| 7,577,511 | B1 | 8/2009 | Tripathi et al. |
| 7,930,087 | B2 | 4/2011 | Gibson et al. |
| 8,215,284 | B2 | 7/2012 | Suzuki et al. |
| 8,839,766 | B2 | 9/2014 | Serrano |
| 2010/0043744 | A1 | 2/2010 | Suzuki et al. |
| 2010/0050993 | A1 | 3/2010 | Zhao et al. |
| 2011/0072893 | A1 | 3/2011 | Malaczynski |
| 2011/0213540 | A1 | 9/2011 | Tripathi et al. |
| 2012/0035793 | A1 | 2/2012 | Kang et al. |
| 2012/0055444 | A1 | 3/2012 | Tobergte et al. |
| 2013/0092127 | A1 | 4/2013 | Pirjaberi et al. |
| 2013/0092128 | A1 | 4/2013 | Pirjaberi et al. |
| 2013/0118443 | A1* | 5/2013 | Tripathi ..... F02D 17/02 123/198 F |
| 2013/0255626 | A1* | 10/2013 | Serrano ..... F02D 41/0087 123/350 |
| 2013/0289853 | A1* | 10/2013 | Serrano ..... F02D 45/00 701/110 |
| 2014/0053802 | A1 | 2/2014 | Rayl |
| 2014/0053804 | A1 | 2/2014 | Rayl et al. |
| 2014/0053805 | A1 | 2/2014 | Brennan et al. |
| 2014/0069178 | A1 | 3/2014 | Beikmann |
| 2014/0069381 | A1 | 3/2014 | Beikmann |
| 2014/0090623 | A1 | 4/2014 | Beikmann |
| 2014/0090624 | A1 | 4/2014 | Verner |

OTHER PUBLICATIONS

International Preliminary Report on Patentability dated Apr. 10, 2015 from International Application No. PCT/US2014/24776.

* cited by examiner

| | | | Skip or Fire | | | | | | | | |
|---|---|---|---|---|---|---|---|---|---|---|---|
| DS Ptrn. # | Dec. # | Binary Value | 1 | 2 | 3 | 4 | 5 | 6 | 7 | 8 | Pattern Range |
| 1 | 0 | 00000000 | 0 | 0 | 0 | 0 | 0 | 0 | 0 | 0 | 0<= FF<1/8 |
| 2 | 1 | 00000001 | 0 | 0 | 0 | 0 | 0 | 0 | 0 | 1 | 0<FF<1/7 |
| 3 | 2 | 00000010 | 0 | 0 | 0 | 0 | 0 | 0 | 1 | 0 | 0<FF<1/6 |
| 4 | 4 | 00000100 | 0 | 0 | 0 | 0 | 0 | 1 | 0 | 0 | 0<FF<1/5 |
| 5 | 8 | 00001000 | 0 | 0 | 0 | 0 | 1 | 0 | 0 | 0 | 0<FF<1/4 |
| 6 | 16 | 00010000 | 0 | 0 | 0 | 1 | 0 | 0 | 0 | 0 | 0<FF<1/4 |
| 7 | 17 | 00010001 | 0 | 0 | 0 | 1 | 0 | 0 | 0 | 1 | 1/5<FF<2/7 |
| 8 | 18 | 00010010 | 0 | 0 | 0 | 1 | 0 | 0 | 1 | 0 | 1/4<FF<1/3 |
| 9 | 32 | 00100000 | 0 | 0 | 1 | 0 | 0 | 0 | 0 | 0 | 0<FF<1/5 |
| 10 | 33 | 00100001 | 0 | 0 | 1 | 0 | 0 | 0 | 0 | 1 | 1/6<FF<1/4 |
| 11 | 34 | 00100010 | 0 | 0 | 1 | 0 | 0 | 0 | 1 | 0 | 1/5<FF<1/3 |
| 12 | 36 | 00100100 | 0 | 0 | 1 | 0 | 0 | 1 | 0 | 0 | 1/4<FF<3/8 |
| 13 | 37 | 00100101 | 0 | 0 | 1 | 0 | 0 | 1 | 0 | 1 | 1/3<FF<2/5 |
| 14 | 41 | 00101001 | 0 | 0 | 1 | 0 | 1 | 0 | 0 | 1 | 1/3<FF<3/7 |
| 15 | 42 | 00101010 | 0 | 0 | 1 | 0 | 1 | 0 | 1 | 0 | 2/5<FF<1/2 |
| 16 | 64 | 01000000 | 0 | 1 | 0 | 0 | 0 | 0 | 0 | 0 | 0<FF<1/6 |
| 17 | 65 | 01000001 | 0 | 1 | 0 | 0 | 0 | 0 | 0 | 1 | 1/7<FF<1/5 |
| 18 | 66 | 01000010 | 0 | 1 | 0 | 0 | 0 | 0 | 1 | 0 | 1/6<FF<1/4 |
| 19 | 68 | 01000100 | 0 | 1 | 0 | 0 | 0 | 1 | 0 | 0 | 1/5<FF<1/3 |
| 20 | 72 | 01001000 | 0 | 1 | 0 | 0 | 1 | 0 | 0 | 0 | 1/4<FF<1/3 |
| 21 | 73 | 01001001 | 0 | 1 | 0 | 0 | 1 | 0 | 0 | 1 | 2/7<FF<2/5 |
| 22 | 74 | 01001010 | 0 | 1 | 0 | 0 | 1 | 0 | 1 | 0 | 1/3<FF<1/2 |
| 23 | 82 | 01010010 | 0 | 1 | 0 | 1 | 0 | 0 | 1 | 0 | 1/3<FF<1/2 |
| 24 | 84 | 01010100 | 0 | 1 | 0 | 1 | 0 | 1 | 0 | 0 | 2/5<FF<1/2 |
| 25 | 85 | 01010101 | 0 | 1 | 0 | 1 | 0 | 1 | 0 | 1 | 3/7<FF<4/7 |
| 26 | 86 | 01010110 | 0 | 1 | 0 | 1 | 0 | 1 | 1 | 0 | 1/2<FF<3/5 |
| 27 | 90 | 01011010 | 0 | 1 | 0 | 1 | 1 | 0 | 1 | 0 | 1/2<FF<5/8 |
| 28 | 91 | 01011011 | 0 | 1 | 0 | 1 | 1 | 0 | 1 | 1 | 3/5<FF<2/3 |
| 29 | 106 | 01101010 | 0 | 1 | 1 | 0 | 1 | 0 | 1 | 0 | 1/2<FF<3/5 |
| 30 | 107 | 01101011 | 0 | 1 | 1 | 0 | 1 | 0 | 1 | 1 | 4/7<FF<2/3 |
| 31 | 109 | 01101101 | 0 | 1 | 1 | 0 | 1 | 1 | 0 | 1 | 3/5<FF<5/7 |
| 32 | 110 | 01101110 | 0 | 1 | 1 | 0 | 1 | 1 | 1 | 0 | 2/4<FF<3/4 |
| 33 | 118 | 01110110 | 0 | 1 | 1 | 1 | 0 | 1 | 1 | 0 | 2/3<FF<3/4 |
| 34 | 119 | 01110111 | 0 | 1 | 1 | 1 | 0 | 1 | 1 | 1 | 5/7<FF<4/5 |
| 35 | 123 | 01111011 | 0 | 1 | 1 | 1 | 1 | 0 | 1 | 1 | 3/4<FF<5/6 |
| 36 | 125 | 01111101 | 0 | 1 | 1 | 1 | 1 | 1 | 0 | 1 | 4/5<FF<6/7 |
| 37 | 126 | 01111110 | 0 | 1 | 1 | 1 | 1 | 1 | 1 | 0 | 5/6<FF<7/8 |
| 38 | 127 | 01111111 | 0 | 1 | 1 | 1 | 1 | 1 | 1 | 1 | 6/7<FF<1 |

101 105 104 103 110

| | | | Skip or Fire | | | | | | | | |
|---|---|---|---|---|---|---|---|---|---|---|---|
| DS Ptrn. # | Dec. # | Binary Value | 1 | 2 | 3 | 4 | 5 | 6 | 7 | 8 | Pattern Range |
| 39 | 128 | 10000000 | 1 | 0 | 0 | 0 | 0 | 0 | 0 | 0 | 0<FF<1/7 |
| 40 | 129 | 10000001 | 1 | 0 | 0 | 0 | 0 | 0 | 0 | 1 | 1/8<FF<1/6 |
| 41 | 130 | 10000010 | 1 | 0 | 0 | 0 | 0 | 0 | 1 | 0 | 1/7<FF<1/5 |
| 42 | 132 | 10000100 | 1 | 0 | 0 | 0 | 0 | 1 | 0 | 0 | 1/6<FF<1/4 |
| 43 | 136 | 10001000 | 1 | 0 | 0 | 0 | 1 | 0 | 0 | 0 | 1/5<FF<2/7 |
| 44 | 137 | 10001001 | 1 | 0 | 0 | 0 | 1 | 0 | 0 | 1 | 1/4<FF<1/3 |
| 45 | 145 | 10010001 | 1 | 0 | 0 | 1 | 0 | 0 | 0 | 1 | 1/5<FF<1/3 |
| 46 | 146 | 10010010 | 1 | 0 | 0 | 1 | 0 | 0 | 1 | 0 | 2/7<FF<2/5 |
| 47 | 148 | 10010100 | 1 | 0 | 0 | 1 | 0 | 1 | 0 | 0 | 1/3<FF<3/7 |
| 48 | 149 | 10010101 | 1 | 0 | 0 | 1 | 0 | 1 | 0 | 1 | 2/5<FF<1/2 |
| 49 | 164 | 10100100 | 1 | 0 | 1 | 0 | 0 | 1 | 0 | 0 | 1/3<FF<2/5 |
| 50 | 165 | 10100101 | 1 | 0 | 1 | 0 | 0 | 1 | 0 | 1 | 3/8<FF<1/2 |
| 51 | 169 | 10101001 | 1 | 0 | 1 | 0 | 1 | 0 | 0 | 1 | 2/5<FF<1/2 |
| 52 | 170 | 10101010 | 1 | 0 | 1 | 0 | 1 | 0 | 1 | 0 | 3/7<FF<4/7 |
| 53 | 171 | 10101011 | 1 | 0 | 1 | 0 | 1 | 0 | 1 | 1 | 1/2<FF<3/5 |
| 54 | 173 | 10101101 | 1 | 0 | 1 | 0 | 1 | 1 | 0 | 1 | 1/2<FF<2/3 |
| 55 | 181 | 10110101 | 1 | 0 | 1 | 1 | 0 | 1 | 0 | 1 | 1/2<FF<2/3 |
| 56 | 182 | 10110110 | 1 | 0 | 1 | 1 | 0 | 1 | 1 | 0 | 3/5<FF<5/7 |
| 57 | 183 | 10110111 | 1 | 0 | 1 | 1 | 0 | 1 | 1 | 1 | 2/3<FF<3/4 |
| 58 | 187 | 10111011 | 1 | 0 | 1 | 1 | 1 | 0 | 1 | 1 | 2/3<FF<4/5 |
| 59 | 189 | 10111101 | 1 | 0 | 1 | 1 | 1 | 1 | 0 | 1 | 3/4<FF<5/6 |
| 60 | 190 | 10111110 | 1 | 0 | 1 | 1 | 1 | 1 | 1 | 0 | 4/5<FF<6/7 |
| 61 | 191 | 10111111 | 1 | 0 | 1 | 1 | 1 | 1 | 1 | 1 | 5/6<FF<1 |
| 62 | 213 | 11010101 | 1 | 1 | 0 | 1 | 0 | 1 | 0 | 1 | 1/2<FF<3/5 |
| 63 | 214 | 11010110 | 1 | 1 | 0 | 1 | 0 | 1 | 1 | 0 | 4/7<FF<2/3 |
| 64 | 218 | 11011010 | 1 | 1 | 0 | 1 | 1 | 0 | 1 | 0 | 3/5<FF<2/3 |
| 65 | 219 | 11011011 | 1 | 1 | 0 | 1 | 1 | 0 | 1 | 1 | 5/8<FF<3/4 |
| 66 | 221 | 11011101 | 1 | 1 | 0 | 1 | 1 | 1 | 0 | 1 | 2/3<FF<4/5 |
| 67 | 222 | 11011110 | 1 | 1 | 0 | 1 | 1 | 1 | 1 | 0 | 3/4<FF<5/6 |
| 68 | 223 | 11011111 | 1 | 1 | 0 | 1 | 1 | 1 | 1 | 1 | 4/5<FF<1 |
| 69 | 237 | 11101101 | 1 | 1 | 1 | 0 | 1 | 1 | 0 | 1 | 2/3<FF<3/4 |
| 70 | 238 | 11101110 | 1 | 1 | 1 | 0 | 1 | 1 | 1 | 0 | 5/7<FF<4/5 |
| 71 | 239 | 11101111 | 1 | 1 | 1 | 0 | 1 | 1 | 1 | 1 | 3/4<FF<1 |
| 72 | 247 | 11110111 | 1 | 1 | 1 | 1 | 0 | 1 | 1 | 1 | 3/4<FF<1 |
| 73 | 251 | 11111011 | 1 | 1 | 1 | 1 | 1 | 0 | 1 | 1 | 4/5<FF<1 |
| 74 | 253 | 11111101 | 1 | 1 | 1 | 1 | 1 | 1 | 0 | 1 | 5/6<FF<1 |
| 75 | 254 | 11111110 | 1 | 1 | 1 | 1 | 1 | 1 | 1 | 0 | 6/7<FF<1 |
| 76 | 255 | 11111111 | 1 | 1 | 1 | 1 | 1 | 1 | 1 | 1 | 7/8<FF<=1 |

101 105 104 103 110

*FIG. 1*

301 302 312 321

| Level | FF | Decimal FF | Sequence # | Engine Cycle # | | | | | | | | |
|---|---|---|---|---|---|---|---|---|---|---|---|---|
| | | | | 1 | 2 | 3 | 4 | 5 | 6 | 7 | 8 | 9 |
| 1 | 0 | 0 | 1 | 0 | | | | | | | | |
| 2 | 1/9 | 0.111111 | 1 | 128 | 64 | 32 | 16 | 8 | 4 | 2 | 1 | 0 |
| 3 | 1/8 | 0.125 | 1 | 128 | | | | | | | | |
| | 1/8 | 0.125 | 2 | 64 | | | | | | | | |
| | 1/8 | 0.125 | 3 | 32 | | | | | | | | |
| | 1/8 | 0.125 | 4 | 16 | | | | | | | | |
| | 1/8 | 0.125 | 5 | 8 | | | | | | | | |
| | 1/8 | 0.125 | 6 | 4 | | | | | | | | |
| | 1/8 | 0.125 | 7 | 2 | | | | | | | | |
| | 1/8 | 0.125 | 8 | 1 | | | | | | | | |
| 4 | 1/7 | 0.142857 | 1 | 129 | 2 | 4 | 8 | 16 | 32 | 64 | | |
| 5 | 1/6 | 0.166667 | 1 | 130 | 8 | 32 | | | | | | |
| | 1/6 | 0.166667 | 2 | 65 | 4 | 16 | | | | | | |
| 6 | 1/5 | 0.2 | 1 | 132 | 33 | 8 | 66 | 16 | | | | |
| 7 | 2/9 | 0.222222 | 1 | 136 | 68 | 34 | 17 | 8 | 132 | 66 | 33 | 16 |
| 8 | 1/4 | 0.25 | 1 | 136 | | | | | | | | |
| | 1/4 | 0.25 | 2 | 68 | | | | | | | | |
| | 1/4 | 0.25 | 3 | 34 | | | | | | | | |
| | 1/4 | 0.25 | 4 | 17 | | | | | | | | |
| 9 | 2/7 | 0.285714 | 1 | 145 | 34 | 68 | 137 | 18 | 36 | 72 | | |
| 10 | 1/3 | 0.333333 | 1 | 146 | 73 | 36 | | | | | | |
| 11 | 3/8 | 0.375 | 1 | 164 | | | | | | | | |
| | 3/8 | 0.375 | 2 | 82 | | | | | | | | |
| | 3/8 | 0.375 | 3 | 41 | | | | | | | | |
| | 3/8 | 0.375 | 4 | 148 | | | | | | | | |
| | 3/8 | 0.375 | 5 | 74 | | | | | | | | |
| | 3/8 | 0.375 | 6 | 37 | | | | | | | | |
| | 3/8 | 0.375 | 7 | 146 | | | | | | | | |
| | 3/8 | 0.375 | 8 | 73 | | | | | | | | |
| 12 | 2/5 | 0.4 | 1 | 165 | 41 | 74 | 82 | 148 | | | | |
| 13 | 3/7 | 0.428571 | 1 | 169 | 82 | 165 | 74 | 149 | 42 | 84 | | |
| 14 | 4/9 | 0.444444 | 1 | 170 | 85 | 42 | 149 | 74 | 165 | 82 | 169 | 84 |
| 15 | 1/2 | 0.5 | 1 | 170 | | | | | | | | |
| | 1/2 | 0.5 | 2 | 85 | | | | | | | | |
| 16 | 5/9 | 0.555556 | 1 | 213 | 106 | 181 | 90 | 173 | 86 | 171 | 85 | 170 |
| 17 | 4/7 | 0.571429 | 1 | 213 | 171 | 86 | 173 | 90 | 181 | 106 | | |
| 18 | 3/5 | 0.6 | 1 | 214 | 181 | 173 | 107 | 90 | | | | |
| 19 | 5/8 | 0.625 | 1 | 218 | | | | | | | | |
| | 5/8 | 0.625 | 2 | 109 | | | | | | | | |
| | 5/8 | 0.625 | 3 | 182 | | | | | | | | |
| | 5/8 | 0.625 | 4 | 91 | | | | | | | | |
| | 5/8 | 0.625 | 5 | 173 | | | | | | | | |
| | 5/8 | 0.625 | 6 | 214 | | | | | | | | |
| | 5/8 | 0.625 | 7 | 107 | | | | | | | | |
| | 5/8 | 0.625 | 8 | 181 | | | | | | | | |
| 20 | 2/3 | 0.666667 | 1 | 219 | 109 | 182 | | | | | | |
| 21 | 5/7 | 0.714286 | 1 | 237 | 219 | 183 | 110 | 221 | 187 | 118 | | |
| 22 | 3/4 | 0.75 | 1 | 238 | | | | | | | | |
| | 3/4 | 0.75 | 2 | 119 | | | | | | | | |
| | 3/4 | 0.75 | 3 | 187 | | | | | | | | |
| | 3/4 | 0.75 | 4 | 221 | | | | | | | | |
| 23 | 7/9 | 0.777778 | 1 | 247 | 123 | 189 | 222 | 239 | 119 | 187 | 221 | 238 |
| 24 | 4/5 | 0.8 | 1 | 247 | 189 | 239 | 123 | 222 | | | | |
| 25 | 5/6 | 0.833333 | 1 | 251 | 239 | 190 | | | | | | |
| | 5/6 | 0.833333 | 2 | 125 | 247 | 223 | | | | | | |
| 26 | 6/7 | 0.857143 | 1 | 253 | 251 | 247 | 239 | 223 | 191 | 126 | | |
| 27 | 7/8 | 0.875 | 1 | 254 | | | | | | | | |
| | 7/8 | 0.875 | 2 | 127 | | | | | | | | |
| | 7/8 | 0.875 | 3 | 191 | | | | | | | | |
| | 7/8 | 0.875 | 4 | 223 | | | | | | | | |
| | 7/8 | 0.875 | 5 | 239 | | | | | | | | |
| | 7/8 | 0.875 | 6 | 247 | | | | | | | | |
| | 7/8 | 0.875 | 7 | 251 | | | | | | | | |
| | 7/8 | 0.875 | 8 | 253 | | | | | | | | |
| 28 | 8/9 | 0.888889 | 1 | 255 | 127 | 191 | 223 | 239 | 247 | 251 | 253 | 254 |
| 29 | 1 | 1 | 1 | 255 | | | | | | | | |

*FIG. 3*

600

655

| FF | | ..... | 1/5 | 2/9 | 1/4 | 2/7 | 1/3 | 3/8 | 2/5 | ..... |
|---|---|---|---|---|---|---|---|---|---|---|
| FF | Pattern # | ..... | 0.2000 | 0.2222 | 0.2500 | 0.2857 | 0.3333 | 0.3750 | 0.4000 | ..... |
| . | . | ... | | | | | | | | |
| . | . | ... | | | | | | | | |
| . | . | ... | | | | | | | | |
| . | . | ... | | | | | | | | |
| 1/5 | 132 | | 33 | | | | | | | |
| 1/5 | 33 | | 8 | 132 | | | | | | |
| 1/5 | 8 | 32 | 66 | 33 | | | | | | |
| 1/5 | 66 | | 16 | 136 | | | | | | |
| 1/5 | 16 | 65 | 132 | 66 | | | | | | |
| 2/9 | 136 | | | 68 | 68 | | | | | |
| 2/9 | 68 | | | 34 | 34 | | | | | |
| 2/9 | 34 | | | 17 | 17 | | | | | |
| 2/9 | 17 | | | 8 | | | | | | |
| 2/9 | 8 | | 66 | 132 | | | | | | |
| 2/9 | 132 | | 16 | 66 | | | | | | |
| 2/9 | 66 | | 8 | 33 | | | | | | |
| 2/9 | 33 | | 136 | 16 | | | | | | |
| 2/9 | 16 | | 132 | 136 | 136 | | | | | |
| 1/4 | 136 | | | 68 | 136 | | | | | |
| 1/4 | 68 | | | 34 | 68 | 137 | | | | |
| 1/4 | 34 | | | 17 | 34 | 68 | | | | |
| 1/4 | 17 | | | 8 | 17 | | | | | |
| 2/7 | 145 | | | | 34 | 34 | | | | |
| 2/7 | 34 | | | | 68 | 68 | | | | |
| 2/7 | 68 | | | | | 137 | | | | |
| 2/7 | 137 | | | | | 18 | | | | |
| 2/7 | 18 | | | | | 36 | 146 | | | |
| 2/7 | 36 | | | | | 72 | | | | |
| 2/7 | 72 | | | | | 145 | | | | |
| 1/3 | 146 | | | | | | 73 | 73 | | |
| 1/3 | 73 | | | | | | 36 | | | |
| 1/3 | 36 | | | | | 72 | 146 | 146 | | |
| 3/8 | 164 | | | | | | | 164 | | |
| 3/8 | 82 | | | | | | | 82 | 148 | |
| 3/8 | 41 | | | | | | | 41 | 74 | |
| 3/8 | 148 | | | | | | | 148 | 165 | |
| 3/8 | 74 | | | | | | | 74 | 82 | |
| 3/8 | 37 | | | | | | | 37 | | |
| 3/8 | 146 | | | | | | 73 | 146 | | |
| 3/8 | 73 | | | | | | 36 | 73 | | |
| 2/5 | 165 | | | | | | | | 41 | |
| 2/5 | 41 | | | | | | | 41 | 74 | |
| 2/5 | 74 | | | | | | | 74 | 82 | |
| 2/5 | 82 | | | | | | | 82 | 148 | |
| 2/5 | 148 | | | | | | | 148 | 165 | |
| ... | ... | | | | | | | | | ... |
| ... | ... | | | | | | | | | ... |
| ... | ... | | | | | | | | | ... |
| ... | ... | | | | | | | | | ... |

650

654

652

665

667

669

660

601 605 603

FIG. 6

710 711 712

701

| FF | .... | 1/5 | 19/90 | 2/9 | 17/72 | 1/4 | 15/56 | 2/7 | 13/42 | 1/3 | 17/48 | 3/8 | 31/80 | 2/5 | .... |
|---|---|---|---|---|---|---|---|---|---|---|---|---|---|---|---|
| Pattern # | .... | 0.2000 | 0.2111 | 0.2222 | 0.2361 | 0.2500 | 0.2679 | 0.2857 | 0.3095 | 0.3333 | 0.3542 | 0.3750 | 0.3875 | 0.4000 | .... |
| .... | .... | | | | | | | | | | | | | | |
| .... | .... | | | | | | | | | | | | | | |
| .... | .... | | | | | | | | | | | | | | |
| 129 | | | | | | | | | | | | | | | |
| 130 | | | | | | | | | | | | | | | |
| 65 | | | | | | | | | | | | | | | |
| 0 | | | | | | | | | | | | | | | |
| 1 | | | | | | | | | | | | | | | |
| 128 | | | | | | | | | | | | | | | |
| 2 | | | | | | | | | | | | | | | |
| 64 | | | | | | | | | | | | | | | |
| 4 | | | | | | | | | | | | | | | |
| 32 | | | | | | | | | | | | | | | |
| 8 | | 8 | 8 | 8 | 8 | | | | | | | | | | |
| 16 | | 16 | 16 | 16 | 16 | | | | | | | | | | |
| 132 | | 132 | 132 | 132 | 132 | | | | | | | | | | |
| 33 | | 33 | 33 | 33 | 33 | | | | | | | | | | |
| 66 | | 66 | 66 | 66 | 66 | | | | | | | | | | |
| 17 | | | 17 | 17 | 17 | 17 | 17 | | | | | | | | |
| 136 | | | 136 | 136 | 136 | 136 | 136 | | | | | | | | |
| 68 | | | 68 | 68 | 68 | 68 | 68 | 68 | 68 | | | | | | |
| 34 | | | 34 | 34 | 34 | 34 | 34 | 34 | 34 | | | | | | |
| 145 | | | | | | | 145 | 145 | 145 | | | | | | |
| 137 | | | | | | | 137 | 137 | 137 | | | | | | |
| 18 | | | | | | | 18 | 18 | 18 | | | | | | |
| 72 | | | | | | | 72 | 72 | 72 | | | | | | |
| 36 | | | | | | | 36 | 36 | 36 | 36 | 36 | | | | |
| 146 | | | | | | | | | 146 | 146 | 146 | 146 | 146 | | |
| 73 | | | | | | | | | 73 | 73 | 73 | 73 | 73 | | |
| 164 | | | | | | | | | | | 164 | 164 | 164 | | |
| 37 | | | | | | | | | | | 37 | 37 | 37 | | |
| 41 | | | | | | | | | | | 41 | 41 | 41 | 41 | .... |
| 148 | | | | | | | | | | | 148 | 148 | 148 | 148 | .... |
| 74 | | | | | | | | | | | 74 | 74 | 74 | 74 | .... |
| 82 | | | | | | | | | | | 82 | 82 | 82 | 82 | .... |
| 165 | | | | | | | | | | | | | 165 | 165 | .... |
| .... | | | | | | | | | | | | | | | .... |
| .... | | | | | | | | | | | | | | | .... |
| .... | | | | | | | | | | | | | | | .... |
| .... | | | | | | | | | | | | | | | .... |

703

705

FIG. 7

| FF and Pattern In command | Binary/ Pattern | 0 0.0000 8s | 1/9 0.1111 f 8s | 1/8 0.1250 f 7s | 1/7 0.1429 f 6s | 1/6 0.1667 f 5s | 1/5 0.2000 f 4s | 2/9 0.2222 f 3s f 4s | 1/4 0.2500 f 3s | 2/7 0.2857 f 2s f 3s | 1/3 0.3333 f 2s | 3/8 0.3750 f s f 2s f 2s | 2/5 0.4000 f s f 2s | 3/7 0.4286 f s f s f 2s | 4/9 0.4444 f s f s f s f 2s | 1/2 0.5000 f s | 5/9 0.5556 2f s f s f s f s |
|---|---|---|---|---|---|---|---|---|---|---|---|---|---|---|---|---|---|
| 1/5 | 10000 | 0 | 100000 | 100000 | 100000 | 100000 | 1 | 1 | 1 | 1 | 1 | 1 | 1 | 1 | 1 | 1 | 1 |
| 2/9 | 1 | 0 | 10 | 10 | 10 | 10 | 10 | 10 | 10 | 10 | 10 | 10 | 10 | 10 | 10 | 10 | 11 |
| 2/9 | 10 | 0 | 100 | 100 | 100 | 100 | 100 | 100 | 100 | 100 | 100 | 101 | 101 | 101 | 101 | 1 | 1 |
| 2/9 | 100 | 0 | 1000 | 1000 | 1000 | 1000 | 1000 | 1000 | 1000 | 1001 | 1 | 1 | 1 | 1 | 1 | 1 | 1 |
| 2/9 | 1000 | 0 | 10000 | 10000 | 10000 | 10000 | 10000 | 10001 | 1 | 1 | 1 | 1 | 1 | 1 | 1 | 1 | 1 |
| 2/9 | 10001 | 0 | 10 | 10 | 10 | 10 | 10 | 100010 | 10 | 10 | 10 | 10 | 10 | 10 | 10 | 10 | 11 |
| 2/9 | 100010 | 0 | 100 | 100 | 100 | 100 | 100 | 1000100 | 100 | 100 | 100 | 101 | 101 | 101 | 101 | 1 | 1 |
| 2/9 | 1000100 | 0 | 1000 | 1000 | 1000 | 1000 | 1000 | 10001000 | 1000 | 1001 | 1 | 1 | 1 | 1 | 1 | 1 | 1 |
| 2/9 | 10001000 | 0 | 10000 | 10000 | 10000 | 10000 | 10000 | 100010000 | 1 | 1 | 1 | 1 | 1 | 1 | 1 | 1 | 1 |
| 2/9 | 100010000 | 0 | 100000 | 100000 | 100000 | 100000 | 1 | 1 | 1 | 1 | 1 | 1 | 1 | 1 | 1 | 1 | 1 |
| 1/4 | 1 | 0 | 10 | 10 | 10 | 10 | 10 | 10 | 10 | 10 | 10 | 10 | 10 | 10 | 10 | 10 | 11 |
| 1/4 | 10 | 0 | 100 | 100 | 100 | 100 | 100 | 100 | 100 | 100 | 100 | 101 | 101 | 101 | 101 | 1 | 1 |
| 1/4 | 100 | 0 | 1000 | 1000 | 1000 | 1000 | 1000 | 1000 | 1000 | 1001 | 1 | 1 | 1 | 1 | 1 | 1 | 1 |
| 1/4 | 1000 | 0 | 10000 | 10000 | 10000 | 10000 | 10000 | 10001 | 1 | 1 | 1 | 1 | 1 | 1 | 1 | 1 | 1 |
| 2/7 | 1 | 0 | 10 | 10 | 10 | 10 | 10 | 10 | 10 | 10 | 10 | 10 | 10 | 10 | 10 | 10 | 11 |
| 2/7 | 10 | 0 | 100 | 100 | 100 | 100 | 100 | 100 | 100 | 100 | 100 | 101 | 101 | 101 | 101 | 1 | 1 |
| 2/7 | 100 | 0 | 1000 | 1000 | 1000 | 1000 | 1000 | 1000 | 1000 | 1001 | 1 | 1 | 1 | 1 | 1 | 1 | 1 |
| 2/7 | 1001 | 0 | 10 | 10 | 10 | 10 | 10 | 10 | 10 | 10010 | 10 | 10 | 10 | 10 | 10 | 10 | 11 |
| 2/7 | 10010 | 0 | 100 | 100 | 100 | 100 | 100 | 100 | 100 | 100100 | 100 | 101 | 101 | 101 | 101 | 1 | 1 |
| 2/7 | 100100 | 0 | 1000 | 1000 | 1000 | 1000 | 1000 | 1000 | 1000 | 1001000 | 1 | 1 | 1 | 1 | 1 | 1 | 1 |
| 2/7 | 1001000 | 0 | 10000 | 10000 | 10000 | 10000 | 10000 | 10001 | 1 | 1 | 1 | 1 | 1 | 1 | 1 | 1 | 1 |
| 1/3 | 1 | 0 | 10 | 10 | 10 | 10 | 10 | 10 | 10 | 10 | 10 | 10 | 10 | 10 | 10 | 10 | 11 |
| 1/3 | 10 | 0 | 100 | 100 | 100 | 100 | 100 | 100 | 100 | 100 | 100 | 101 | 101 | 101 | 101 | 1 | 1 |
| 1/3 | 100 | 0 | 1000 | 1000 | 1000 | 1000 | 1000 | 1000 | 1000 | 1001 | 1 | 1 | 1 | 1 | 1 | 1 | 1 |
| 3/8 | 1 | 0 | 10 | 10 | 10 | 10 | 10 | 10 | 10 | 10 | 10 | 10 | 10 | 10 | 10 | 10 | 11 |
| 3/8 | 10 | 0 | 100 | 100 | 100 | 100 | 100 | 100 | 100 | 100 | 100 | 101 | 101 | 101 | 101 | 1 | 1 |
| 3/8 | 101 | 0 | 10 | 10 | 10 | 10 | 10 | 10 | 10 | 10 | 10 | 1010 | 1010 | 1010 | 1010 | 10 | 11 |
| 3/8 | 1010 | 0 | 100 | 100 | 100 | 100 | 100 | 100 | 100 | 100 | 100 | 10100 | 10100 | 10101 | 10101 | 1 | 1 |
| 3/8 | 10100 | 0 | 1000 | 1000 | 1000 | 1000 | 1000 | 1000 | 1000 | 1001 | 1 | 101001 | 1 | 1 | 1 | 1 | 1 |
| 3/8 | 101001 | 0 | 10 | 10 | 10 | 10 | 10 | 10 | 10 | 10010 | 10 | 1010010 | 10 | 10 | 10 | 10 | 11 |
| 3/8 | 1010010 | 0 | 100 | 100 | 100 | 100 | 100 | 100 | 100 | 100100 | 100 | 10100100 | 101 | 101 | 101 | 1 | 1 |
| 3/8 | 10100100 | 0 | 1000 | 1000 | 1000 | 1000 | 1000 | 1000 | 1000 | 1001000 | 1 | 1 | 1 | 1 | 1 | 1 | 1 |
| 2/5 | 1 | 0 | 10 | 10 | 10 | 10 | 10 | 10 | 10 | 10 | 10 | 10 | 10 | 10 | 10 | 10 | 11 |
| 2/5 | 10 | 0 | 100 | 100 | 100 | 100 | 100 | 100 | 100 | 100 | 100 | 101 | 101 | 101 | 101 | 1 | 1 |
| 2/5 | 101 | 0 | 10 | 10 | 10 | 10 | 10 | 10 | 10 | 10 | 10 | 1010 | 1010 | 1010 | 1010 | 10 | 11 |

MANAGING ENGINE FIRING PATTERNS AND PATTERN TRANSITIONS DURING SKIP FIRE ENGINE OPERATION

RELATED APPLICATIONS

This application claims priority of U.S. Provisional Application No. 61/801,472, filed Mar. 15, 2013, which is incorporated herein by reference.

BACKGROUND

The present invention relates generally to the management of transitions between different firing patterns used during skip fire operation of an engine.

Skip fire engine control is understood to offer a number of benefits including the potential of increased fuel efficiency. In general, skip fire engine control contemplates selectively skipping the firing of certain cylinders during selected firing opportunities. Thus, for example, a particular cylinder may be fired during one firing opportunity and then may be skipped during the next firing opportunity and then selectively skipped or fired during the next. This is contrasted with conventional variable displacement engine operation in which a fixed set of the cylinders are deactivated during certain low-load operating conditions.

Many skip fire controllers are arranged to provide a set of available firing patterns or firing fractions. In some circumstances the set of available firing patterns or fractions will vary as a function of various operating parameters such as engine load or speed. Typically the available firing patterns are selected, in part, based on their vibration characteristics. Although careful selection of the available firing patterns helps facilitate smooth operations, transitions between different firing patterns can cause undesirable noise, vibration and harshness (NVH) concerns. Therefore, there are continuing efforts to provide improved schemes for transitioning between different firing patterns or different firing fractions.

SUMMARY

Various methods and data structures for managing transition between different firing fractions during skip fire operation of an engine are described. In one embodiment, transitions are constrained to occur when firing sequence segments of a designated length are shared by the first and second firing fractions. Is some circumstances transitions between a current and target firing fraction may be conducted as a series of steps through intermediate firing fractions. Such an approach is useful, for example, when the current and target firing fractions do not share common sequences of the designated length. Rules may be provided to require operation at such intermediate firing fractions for minimum stays.

In a separate aspect, a data structure that uses current firing fraction phase as a first index and a target firing fraction as a second index may be used to determine a phase of the target firing fraction to enter at a transition. The entries in such a data structure may provide a firing decision indicative of whether or not to fire the next working chamber and a representation of a phase to be utilized as the current firing fraction phase when making a following firing decision. The nature of the data structures used may vary widely. By way of example, lookup tables work well.

In various embodiments, constraints may be provided that limit the number of intermediary firing fractions that may be skipped during a transition thereby requiring that some transitions step through one or more intermediate firing fractions.

For example, a rule may dictate that jumps of no more than a designated maximum number of firing fractions may be made during any single step of the transition. The designated maximum number of firing fractions that may be jumped in any single step of a transition may vary as a function of a variety of relevant factors, as for example: engine speed; the first operational firing fraction; the direction of the transition; and selected operating conditions at the time of the transition.

In still other embodiments, any time the current and target firing fractions are separated by intermediate firing fractions, each available intermediate firing fraction must be stepped through in a sequential step-wise manner as part of the transition. As mentioned above, latency requirements within each intermediate firing fraction may be imposed such that each intermediate firing fraction must be executed for a designated period—as for example, a minimum of one full engine cycles, a set of full engine cycles or other appropriate period.

In still another embodiments generally related to the first described transition approach, if no sequences of the designated length are shared between the first and second firing fractions, than an intermediate firing fraction that is not a normal operational firing fraction may be used to facilitate the transition.

BRIEF DESCRIPTION OF THE DRAWINGS

The invention and the advantages thereof, may best be understood by reference to the following description taken in conjunction with the accompanying drawings in which:

FIG. 1 is a table that lists the 76 most evenly spaced sequences that are possible in an 8-bit string.

FIG. 3 is a table that shows all of the 8-bit strings that are possible for each firing pattern in a skip fire controller that allows all firing fractions between zero and one with an integer denominator of nine or less.

FIG. 6 is a table that shows a segment of a transition table constructed in accordance with another embodiment.

FIG. 7 is a table that shows a segment of a transition table that uses mid-point firing fractions in the transition between adjacent firing fractions in a skip fire controller in accordance with yet another embodiment.

In the drawings, like reference numerals are sometimes used to designate like structural elements. It should also be appreciated that the depictions in the figures are diagrammatic and not to scale.

DETAILED DESCRIPTION

Figure 2:
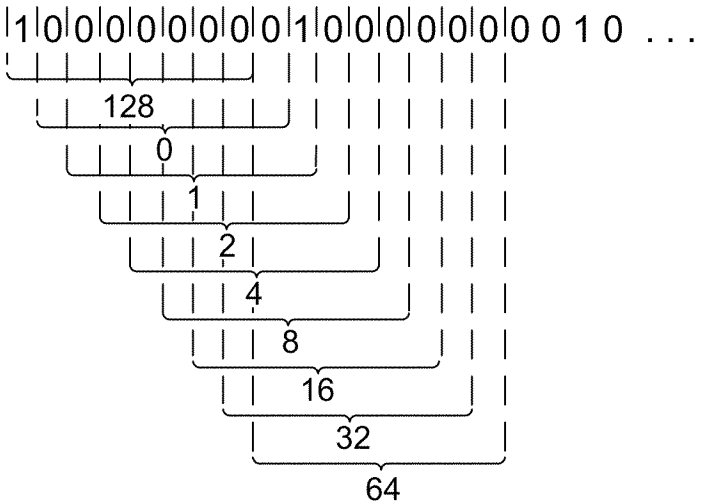
FIG. 2 is a diagram illustrating the 8-bit segments that are possible for a firing fraction of $1/9^{th}$ labeled as their decimal equivalents.

The present invention relates generally to the management of transitions between different firing patterns used during skip fire operation of an engine. In general, transitions are preferentially made at points in the current firing pattern where a segment of a given length in the target firing pattern matches a corresponding sequence in the current firing pattern. The length of the matching sequence strings may be varied, but preferably string lengths in the range of one to eight are used to facilitate smoother transitions.

Although the concept of skip fire control has been around for some time and its potential benefits with respect to fuel economy are known, to date, skip fire control has not achieved wide spread acceptance. The applicant has developed a dynamic skip fire control technology that has the potential of making skip fire control of standard automobile engines practical and has filed a number of patent applications directed at various dynamic skip fire control arrangements and the integration of skip fire control into powertrain control in general. These include U.S. Pat. Nos. 7,954,474; 7,886,715; 7,849,835; 7,577,511; 8,099,224; 8,131,445; 8,131,447; and 8,336,521 U.S. patent application Ser. Nos. 13/309,460, 13/654,217, 13/654,244, 13/774,134 and U.S. Provisional Patent Application Nos. 61/682,065; 61/677,888; 61/683,553; 61/682,151; 61/682,553; 61/682,135; and 61/682,168; each of which is incorporated herein by reference in its entirety. Many of these applications describe dynamic skip fire control in which the determination of whether or not to fire a particular cylinder is made shortly before each working cycle begins.

It has been observed that for any given skip fire firing fraction, the smoothest operation tends to occur when the firings are spaced in the most even manner possible for that particular firing fraction. Some of the patents and patent applications identified above describe the use of a sigma-delta converter when making firing decisions. When first order sigma delta conversion is used, the firings are inherently spaced in the most even manner. Many older skip fire controllers define a set of available firing patterns and often at least some of those firing patterns utilize the most even spacing of the firings for the associated firing fraction as well.

When most even spacing of the firings is given as a constraint, the firing pattern associated with any quantized firing fraction is set. That is, for any quantized firing fraction, it is possible to identify the associated firing pattern that has the most evenly spaced firings. Although the firing pattern associated with a particular firing fraction may be fixed, the point of entry into the sequence (sometimes referred to herein as the "phase" of the sequence) may vary based on the starting conditions.

Looked at an entirely different way, in a physical engine having a fixed number of cylinders there are a limited set of sequences that those cylinders can actually be fired in while still conforming to a "most evenly spaced firings" constraint. For example, if a desired firing fraction is ½, firing pattern of F-S-F-S . . . and S-F-S-F . . . are most evenly spaced and may be used. In contrast, firing patterns of S-S-F-F . . . and F-F-S-S . . . would never satisfy the most evenly spaced firing constraints. Here "F" refers to a fire and "S" refers to a skip.

For every available firing faction a list of possible firing sequences can be defined and therefore, all of the potential physical cylinder firing sequences can be defined. More generally, for any given string length, it is possible to define all of the combination of patterns that satisfy the most equal spacing criteria for all possible firing fractions.

In a four cylinder engine, during any particular engine cycle there are a total of sixteen (i.e., $2^4$) different sequences that the four cylinders could potentially be fired in during any particular engine cycle. Two of those sixteen different sequences could never be used at any firing fraction if the engine is constrained to only utilize most evenly spaced firings. Specifically, F-F-S-S and S-S-F-F would not be appropriate for any firing fraction, but all of the other combinations would be possible under at least some conceptually possible firing fractions.

In a six cylinder engine, there are a total of 64 (i.e., $2^6$) different sequences that the six cylinders could potentially be fired in during any particular engine cycle and of those, 36 satisfy the most even spacing criteria at some firing fraction. In an eight cylinder engine, there are a total of 256 (i.e., $2^8$) different sequences that the eight cylinders could potentially be fired in during any particular engine cycle and of those, 76 satisfy the most even spacing criteria at some firing fraction.

More generally, the table below gives the number of different sequences for strings of different lengths that can conform with the most even spacing criteria at some firing fraction:

| String Length | No. of Possible Sequences | No. of Most Evenly Spaced Patterns |
|---|---|---|
| 4 | 16 | 14 |
| 6 | 64 | 36 |
| 8 | 256 | 76 |

FIG. 1 is a table that lists the 76 most evenly spaced sequences that are possible in an 8-bit string. An eight 8-bit string was chosen for illustration because it can be considered to correspond to the cylinders of an 8 cylinder engine and therefore the number of cylinders that are potentially fired in one engine cycle (e.g., two rotations of the crankshaft in a 4-stroke engine). In the table, each row corresponds to an associated one of the 76 possible sequences. Each column corresponds to a particular characteristic of the sequence. In the table, the leftmost column 101 is simply a row number that provides an identifying number for each unique sequence. This column is labeled "DS Pattern #." in the table because the list corresponds to the 76 eight bit strings that can be generated by a first order sigma delta converter during steady state operation at various firing fractions. Column set 103 includes a distinct column for each cylinder in sequential firing time order with entries in each row combining to indicate the order of the firings with "1's" representing fires and "0's" representing skips. In the illustrated example, each firing decision is a binary decision—i.e., skip or fire and therefore the 8 cylinder firing pattern amounts to a digital byte (8-bits) which has a corresponding binary representation which is given in column 104 and a corresponding decimal representation which is given in column 105. Column 110 indicates the range of engine firing fraction that the associated sequence may actually be used in.

Some of the firing fractions may be rendered using different sets of cylinders while still conforming to a most equal spacing requirement. For example, a firing fraction of $1/8^{th}$ could be rendered as any one of: 1-0-0-0-0-0-0-0, 0-1-0-0-0-0-0-0, 0-0-1-0-0-0-0-0, 0-0-0-0-1-0-0-0, 0-0-0-0-0-1-0-0, 0-0-0-0-0-0-1-0, or 0-0-0-0-0-0-0-1 (which are represented as 128, 64, 32, 16, 8, 4, 2 and 1 in decimal respectively). Each of these firing sequences renders an overall firing fraction of ⅛ and they differ only in the phase of the firing. Some firing fractions have corresponding firing sequences having a repeating pattern length that does not repeat evenly within an 8-bit segment and therefore a number of different 8-bit strings can be parsed from such pattern. By way of example, a firing sequence of $1/9^{th}$ requires a firing followed by eight skips. When viewed in 8-bit segments, there are nine possible mappings. These can be seen diagrammatically in FIG. 2 which labels each segment using its decimal equivalent. As seen therein, the possible 8-bit segments for a firing fraction of $1/9^{th}$ can be represented as 128, 0, 1, 2, 4, 8, 16, 32 and 64 in decimal form respectively. It is worth noting that eight of the nine segments shown in FIG. 2 are identical to a corresponding segment that is possible using a firing fraction of $1/8^{th}$. A similar analysis of a $1/7^{th}$ firing fraction revels that the following 8-bit segments are possible at a firing fraction of $1/7^{th}$: 129, 64, 32, 16, 8, 4 and 2. In this case, the potential 8-bit sequences again have substantial overlap with the 8-bit sequences that are possible with firing fractions of $1/8^{th}$ and $1/9^{th}$. That isn't surprising given that the firing fractions $1/7^{th}$, $1/8^{th}$ and $1/9^{th}$ are relatively close together corresponding to approximately 14.3%, 12.5% and 11.1% firing density respectively.

It should be apparent that for any given most evenly spaced firing pattern, the number of potential 8-bit sequences can be readily determined. More generally, if an engine has a set of available firing fractions or firing patterns, all of the potential 8-bit sequences for each of the available firing fractions/patterns can be readily determined. Consider for example, a skip fire controller that can be operated at any firing fraction between zero (0) and one (1) having an integer denominator of nine (9) or less. Such a controller would have a set of 29 potential firing fractions—as firing density increases, specifically: 0, 1/9, 1/8, 1/7, 1/6, 1/5, 2/9, 1/4, 2/7, 1/3, 3/8, 2/5, 3/7, 4/9, 1/2, 5/9, 4/7, 3/5, 5/8, 2/3, 5/7, 3/4, 7/9, 4/5, 5/6, 6/7, 7/8, 8/9 and 1.

FIG. 3 is a table that shows all of the 8-bit segments that are possible for each firing pattern in such a skip fire controller. In the table, each major row group corresponds to a different one of the 29 potential firing fractions—which are referred to as different skip fire levels in the figure. The firing patterns associated with some of the illustrated firing fractions do not utilize all of the cylinders and therefore, there may be more than one independent sequence that can be used to implement that particular fraction. By way of example, a firing fraction of 1/2 can be implemented in two mutually exclusive manners (i.e., as either a 1-0-1-0-1-0-1-0 or alternatively 0-1-0-1-0-1-0-1) while still providing most even spacing. In another example, a firing fraction of $1/8^{th}$ can be implemented in eight mutually exclusive sequences. These mutually exclusive alternative sequences are listed as separate rows in FIG. 3.

Column 301 indicates the level and column 302 indicates the associated firing fraction for each sequence. Column 312 gives a unique identifier to each sequence for any particular level. Column 321 gives a complete list of the 8-bit segments that are used in the associated sequence (with the list being provided converted to decimal equivalent form). It can be seen that many of the 8-bit segments are used in more than one firing fraction. By way of example, 34 (corresponding to 0-0-1-0-0-0-1-0) is used in the 2/9, 1/4 ($3^{rd}$) and 2/7 sequences; 90 (0-1-0-1-1-0-1-0) is used in the 5/9, 4/7 and 3/5 sequences; 170 (1-0-1-0-1-0-1-0) is used in the 4/9, 1/2 ($1^{st}$), and 5/9 sequences; and 85 (0-1-0-1-0-1-0-1) is used in the 4/9, 1/2 ($1^{st}$), and 5/9 sequences. Not surprisingly, the commonly used firing segments occur in fairly close firing fractions aligned by the firing density and each of the sequences in the illustrated embodiment have at least one 8-bit segment that matches one of its neighbors.

This characteristic of nearby firing fractions can be used to help smooth transitions between different firing fractions. Specifically, the transition between firing fractions can be controlled in a manner that causes transitions to occur at a point where a string of a designated length matches between the current firing fraction and the firing fraction that is being transitioned to. To facilitate understanding, consider an example of a transition from a firing fraction of 5/9 (55.6%) to a firing fraction of 3/5 (60%) in the example controller illustrated in FIG. 3. This contemplates a transition from level 16 (corresponding to 5/9) to level 18 (corresponding to 3/5). As can be seen in the entries in column 321 associated with those rows, the 5/9 firing fraction utilizes the 8-bit segments: 213, 106, 181, 90, 173, 86, 171, 85, 170. The 3/5 firing fraction utilizes the 8-bit segments: 214, 181, 173, 107 and 90. It can be seen that two of those segments (i.e., 90 and 181) are common between the two firing fractions. As a general rule, undesirable vibrations can be mitigated by making transitions to a new firing fraction at such common points in the firing sequence. When a match exists between the current and target firing fractions, the match will occur within a number of firing opportunities equal to the repeating pattern length at the most. In the example case, the pattern repeats every nine firing opportunities which would suggest a maximum delay until a match occurs of nine firing opportunities—which amounts to just over one engine cycle. However, there are two matches in the sequences and therefore a match must occur within eight firing opportunities—i.e., within one engine cycle in the example. That would mean that a match must occur within 0.05 seconds in an engine operating at 2400 RPM. It should be noted that if the firing fraction is transitioning in the other direction (i.e., from 3/5 to 5/9), the maximum delay before a match occurs would be just three firing opportunities which is less than half an engine cycle in the example. Although the maximum matching time would vary as a function of the engine speed, the sequence length of the current firing fraction, and the number of cylinders in the engine, it should be appreciated that the changes can be made very quickly using the described approach.

There will be many times when the transition between the current operating firing fraction and a target firing fraction involves a change that is much larger than in the example given above, such that the current operating and target firing fractions do not have any overlapping firing strings. In such cases, the transition may be made stepwise through any number of different intermediate firing fractions, with each step being accomplished at an appropriate matching location in the sequence. Since the transitions between compatible firing fractions occur very quickly, such a stepped approach can still be accomplished quickly enough for most applications. Of course, if the requested change in firing fraction is so large that a stepwise transition is deemed too slow, a more direct change in firing fraction can be ordered with the tradeoff that more noticeable NVH may be observed. In some preferred embodiments, the transitions are constrained to step through every firing fraction between the original firing fraction and the target firing fraction.

In the example above, a string length of eight (8) was used, which happened to correspond to the number of cylinders in the engine used in the example. This is convenient, however, neither of these constraints is required. Thus, the string length considered for the purposes of transition may be widely varied and there is no need for the string length to correspond to the number of cylinders in the controlled engine. Generally, string lengths on the order of 4-8 are preferred, although depending on design goals, using string lengths as low as 1 can provide improved vibration characteristic.

Figure 4:
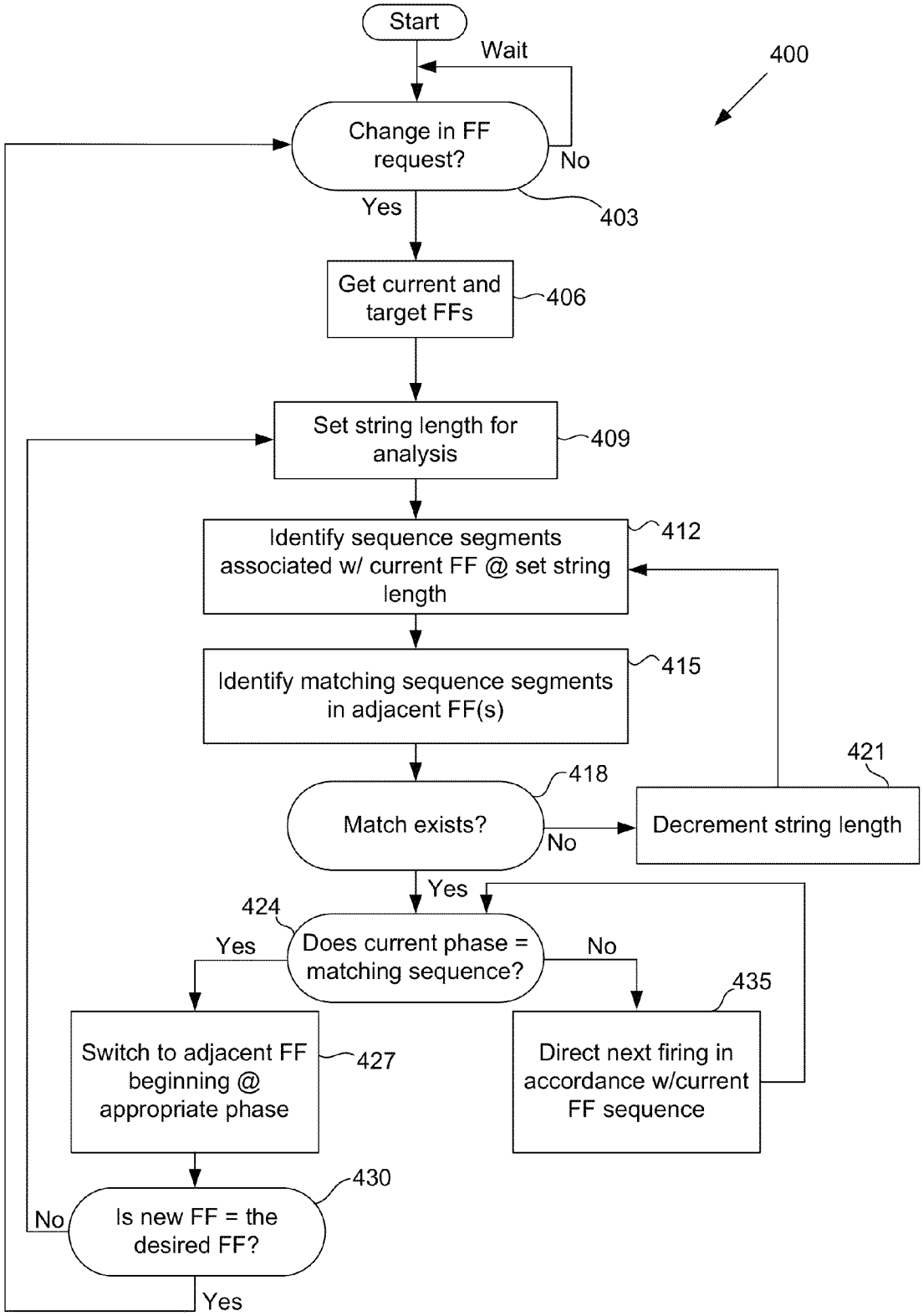
FIG. 4 is a flow chart illustrating a method of transitioning between firing fractions in accordance with an embodiment of the present invention.

In the example given in FIG. 3, there are some sequences that do not have any matches in one direction. For example, the firing fraction of 3/8—sequence three has only one associated 8-bit string—i.e., string segment 41 as seen in column 321. There is a match at a higher firing fraction (at level 12, which corresponds to a 2/5 or 40% firing fraction), but there is no direct match at a lower firing fraction. When such a situation occurs, there are several things that can be done to manage such transition. For example, in many situations a designated transition sequence that is chosen specifically for use during that transition can be used. In other embodiments, an intermediate firing fraction (between the adjacent operational firing fractions) can be used in the transition as described in more detail below with respect to FIG. 7. By way of example, when an intermediate firing fraction of 31/80 is used during the transition, the transition can be handled in the described manner. In another more algorithmic approach, the bit length of the analyzed string can be altered (i.e., shortened) and the transition performed at the matching point of the shorter string. By way of example, instead of analyzing 8-bits, 7-bits could be analyzed as described below with respect to FIG. 4. When the shorter bit length is analyzed, 3/8 does indeed have a match at the next lower firing fraction (1/3 in this case) and the transition can be made upon a 7-bit match.

Shortening of the analyzed string can also be used to facilitate larger jumps between firing fractions. It should be appreciated that the analysis of shorter string lengths will statistically cause more matches to occur between firing fractions and matches to occur between more disparate firing fractions. Therefore, if for any reason a more rapid transition is desired than would be accomplished by stepping through several transitions, the string length analyzed can be reduced which may facilitate making larger firing fraction steps during the transition, thereby speeding-up the transition. To provide an extreme example, if the string length analyzed is reduced to three bits, the transition from a 3/8 firing fraction to any other firing fraction other than one or zero can be made in a single step. Generally string lengths in the range of 1 to 8-bits are believed to be suitable for many applications although string lengths on the order of 4 to 8 are presently preferred. A string length of 8-bits as provided in the example works quite well in applications having a relatively large number of available firing fractions such as the 29 level example provided above.

The described transition management approach can be implemented in almost any skip fire controller. By way of example, it may be implemented in the form of a skip fire transition module 509 that is part of a skip fire firing control module (firing controller) 503 that is part of a powertrain or engine control unit (ECU) 500 as diagrammatically illustrated in FIG. 5. The ECU is arranged to direct the operation of an engine 520. When the engine is operated in a skip fire operational mode, the firing controller 503 directs the specific firings and cooperates with the ECU to insure that the various engine components such as the throttle position, cam timing, spark timing, fuel charge, etc. are set appropriately so that the engine will deliver the desired output during skip fire operation. In the illustrated embodiment, the firing controller 503 also includes a firing fraction calculator 511 responsible for determining the firing fraction that is appropriate for delivering the desired engine output and a firing timing determining unit 513 arranged to determine which specific cylinders to fire in order to implement the desired firing fraction. The transition module 509 is informed of changes in the desired firing fraction from firing fraction calculator 511 and determines the appropriate timing for transitions between firing fractions. The transition module 509 then cooperates with the firing timing determining unit 513 to facilitate the appropriate transition between different requested firing fractions.

The transition module 509 and more generally the skip fire controller 503 can be implemented in a wide variety of manners including, for example, algorithmically by a processor, through the use of look-up table, through the use discreet logic (analog or digital), by a combination of such techniques and/or in any other suitable manner.

In some preferred embodiments, the transition module 509 is configured to require that the transition between an original firing fraction and a target firing fraction be accomplished by a step-wise transition through each intermediate firing fraction between the original firing fraction and the target firing fraction using the described firing sequence segment matching approach. However, this is not a requirement. Rather, when sequence segment matches occur between more disparate firing fractions, the transition module can be configured to select the largest possible conforming jump during each transition. In some embodiments, the nature of the transitions may be based in part on the magnitude of the requested change in firing fraction. For example, if a large change in firing fraction is desired, the analyzed string may be reduced to fewer bits (including possibly as little as a single bit) to insure a more instantaneous transition. This may be particularly desirable in circumstances where a large step change in firing fraction is requested, as may occur if a driver steps on or releases the accelerator pedal. Although such changes might be expected to induce more noticeable NVH characteristics, that tradeoff may be desirable to help ensure that the engine is very responsive to requests for large changes in the engine output.

FIG. 6 presents another way to view the transition points between firing fractions. To facilitate an understanding of this approach a table 600 is constructed by firing fraction which includes rows 652 for each possible 8-bit string associated with each firing fraction. The rows are grouped in row sets 650 by firing fraction. Thus, the row identifier 654 for each row includes a first value corresponding to the firing fraction and a second value corresponding to one of the 8-bit strings associated with that firing fraction.

The columns 655 are based on firing fraction alone with the columns being sequenced at progressively higher firing fractions. The portion of the table of interest is the region centered around the intersection of the same firing fractions. These "identity" regions 660 are surrounded by solid lines—and more particularly, a solid line bounds a complete list of the 8-bit string states for each unique firing sequence 101 identified in FIG. 1. As discussed above, some of the firing fractions have more than one associated unique firing sequence 101 and therefore those firing fractions have multiple independent firing sequences that are bounded by solid lines. In an eight cylinder engine, the 8-bit firing history can be considered a historical "engine cycle state"—that is the firing history status of each of the cylinders over the course of the last engine cycle at any given time. For the purposes of illustration, it can be useful for some to think of the history in that manner, although again, there is no need for the length of history reviewed to correspond to the actual number of cylinders in the engine.

For each row, the table entries represent the next eight firing decisions that should be made in the event that the firing fraction associated with the associated columns is used as the basis for making those firing decision. When viewed in this manner, the first bit of the 8-bit string represented by a table entry 665 represents the next (first following) firing decision, the second bit represents the second firing decision and so on—with a "1" corresponding to a fire, and a "0" corresponding to a skip. During operation of an engine in the skip fire mode, the appropriate firing decision for the next firing opportunity at the same firing fraction can conceptually be looked up by using the current firing fraction and the known history of the last 8 firing opportunities as the index to the table 600 and then looking at the entry associated with that same firing fraction. The table entry indicates gives the next firing decision as the first bit in the table entry. To illustrate this principle, consider a situation where the firing fraction is 1/4 and the current 8-bit firing history is 68. The corresponding table entry 665 is 68, which means that the next eight firing decisions at the same firing fraction will be 0-1-0-0-0-1-0-0. Since the first bit of that sequence is a zero, that implies that the next firing decision should be a skip.

More interesting is the values of the table entries in the adjacent column(s) which define when and how to implement a change in firing fraction. If at this state (i.e. a firing fraction of ¼ with the current history being 68) a request is made to increase the firing fraction to 2/7, then the corresponding table entry 667 in the 2/7 column is read and that will provide the next eight firing decisions at the new firing fraction of $2/7^{th}$. Table entry 667 is "137" which corresponds to 1-0-0-0-1-0-0-1. Alternatively, if at the same point, a decision was made to transition to a lower firing fraction of 2/9, then by reading table entry 669 it can be seen that the next eight firing decisions should be "34" which corresponds to 0-0-1-0-0-0-1-0. Thus, the table defines appropriate transitions between different firing fractions that are consistent with the matching history transition protocol described above.

It should be appreciated that the reason this works in the illustrated example of FF=¼ and history sequence=68 is that the sequence 68 occurs at each of the relevant firing fractions, i.e., 2/7, ¼ and 2/9. Therefore, the transition can be made immediately and the table simply indicates the phase at which the new sequence is entered. However, as described above, not all of the possible sequence segments will match in one or both directions. For example, as best seen in FIG. 3, a firing fraction of 2/9ths has nine possible engine cycle states. Four of those states, (136, 68, 34 and 16), overlap with engine cycle states of the next highest firing fraction—¼; and 5 of those engine cycle states, (8, 132, 66, 33 and 16), overlap with the next lower firing fraction—⅕. Thus, in the table of FIG. 6, only the four engine cycle states that overlap the next highest firing fraction of ¼ have corresponding transition values in the corresponding transition column. Similarly, only the five engine cycle states that overlap the next lowest firing fraction of ⅕ have corresponding transition values in the corresponding column. Finally, engine cycle state 17 does not overlap with either the next higher or the next lower engine state and accordingly, there are no transition values associated with that state.

As discussed above, in the event that a transition request is made at the time that the engine cycle state doesn't overlap with a possible engine cycle state available at the desired target firing fraction, this can readily be determined by the lack of an entry in the column corresponding to the target firing fraction. In such circumstances, the current firing sequence may be continued until such a transition point occurs at which point the appropriate transition sequence can be looked up in the table.

In the illustrated embodiment, transition values are only provided for the engine cycle states that are also used in the target firing fraction. However, in other embodiments it is possible for the table to also define a specific desired transition pattern for any particular transition. This is particularly useful in circumstances where a particular firing pattern/phase in current use does not have any engine cycle states that match with the target firing fraction. In such circumstances, the table can be populated with a value that provides the most desirable transition even though it doesn't conform with the preferred transition framework described above.

In the embodiment illustrated in FIG. 6, transition values are only provided for the immediately adjacent firing fractions. This works well in a transition management system designed to sequentially step through adjacent firing fractions during any managed transition. In embodiments in which larger jumps are desired or permitted, the table can be constructed to identify the engine cycle states that are appropriate for any larger permitted transitions as well simply by providing the appropriate transition values in the appropriate columns.

Referring next to FIG. 7, yet another transition management variation will be described. For the purpose of this example, consider the controller that is designed to utilize the 29 relatively closely spaced firing fractions described above. As explained above, not all of the possible 8-bit engine cycle states associated with each available firing fraction match with an engine cycle state that is available at the next lower, and/or next higher firing fraction. However, it has been observed that at the 8-bit level, an intermediate firing fraction can be selected between two adjacent firing fractions that will inherently utilize all of the engine cycle states in both of the adjacent operational firing fractions. This property is illustrated in FIG. 7. In this figure, each column is associated with a particular firing fraction and the columns are arranged in ascending order. Every other column corresponds to one of the 29 available operational firing fractions and lists all of the engine cycles states that are available at that firing fraction. The intervening columns list selected engine cycle states that are possible at an intermediate firing fraction between two adjacent operational firing fractions.

Consider, for example, a transition between a ⅜ firing fraction and a 2/5 firing fraction. ⅜ is equivalent to 30/80 and 2/5 is equivalent to 32/80 and the midpoint between the two is 31/80. Column 710 lists the firing fractions that are available at a ⅜ firing fraction and column 712 lists the firing fractions that are available at a 2/5 firing fraction. Column 711 lists firing factions that are available at a firing fraction at the midpoint—31/80. It can be seen that every one of the engine cycle states at the operational firing fractions ⅜ and 2/5 are also available at the intermediate firing fraction. Therefore, another conceptual approach to viewing the management of a transition from 2/5 to ⅜ would be to immediately transfer to the new firing fraction (e.g., from ⅜ to 2/5) if the current engine cycle state has a match in the target firing frequency. When there is not a match, a transition can always immediately be made to the intermediate firing fraction (e.g. to 31/80 in the example). At the intermediate firing fraction, there will always eventually be an engine cycle state reached that matches an engine cycle state that is available at the adjacent target firing fraction and the transition to the new firing fraction can be completed at such a position. In many situations the actual transition path followed using the intermediate firing fraction approach will be exactly the same as would occur under the previously described approach in which the firing sequence associated with the current firing fraction is used until an engine cycle state is reached that has an analog in the target firing sequence. However an advantage to the midpoint transition approach is that it also facilitates transitions in circumstances where there are no direct matched engine cycle states between the current and target firing fractions as may occur with certain firing fractions as discussed above.

Figure 5:
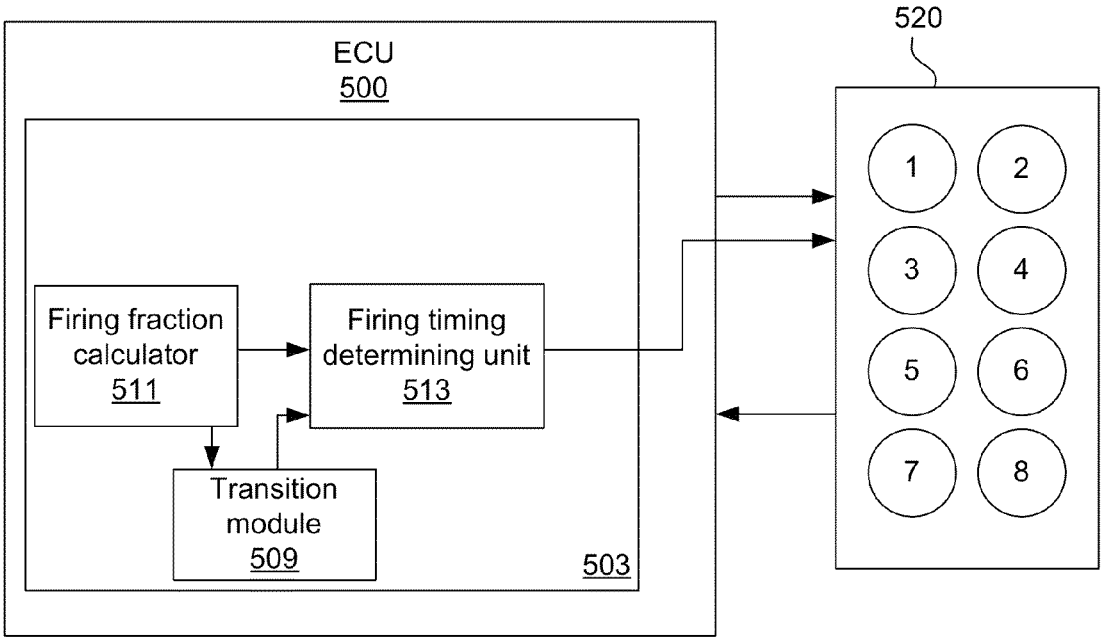
FIG. 5 is a diagrammatic block diagram of an engine control unit (ECU) incorporating a skip fire firing controller in accordance with one embodiment of the present invention.

From the forgoing, it should be apparent that there are many ways that the described transition approach can be implemented. One additional algorithmic approach is illustrated in the flow chart of FIG. 4. The transition management process 400 may be carried out by a transition control module 509 within firing controller 503 of engine control unit 500 as illustrated in FIG. 5 or by any other suitable mechanism. In the illustrated embodiment, the process begins when the engine is placed in a skip fire operational mode. This is worth noting because the described process can be used for transitioning into and out of skip fire mode in addition to managing transitions between different skip fire firing fractions. Initially, the controller awaits a request for a change in the firing fraction (FF) as represented by block 403. When a firing fraction change is requested, the controller gets the current and target (i.e., requested) firing fractions (406), and sets the string length for analysis to a appropriate string length (409). In the illustrated embodiment, the transition controller is arranged to manage transitions by stepping through firing fractions that are intermediate to the current and target firing fractions. Normally the string length will be set to a default string length in 409. As suggested above, the default string length may vary based on the transition characteristics desired. By way of example, a default string length of 8-bits may be used in some implementations. Although the default string length would typically be used, there may be operating conditions which dictate a faster transition—as for example might be desirable if the driver floors the accelerator pedal (which might call for shortening the string length). In such cases the default string length can be altered appropriately to provide the desired response. In still other special circumstances the described transition management can be skipped all together.

The transition controller identifies the sequence segments associated with the current firing fraction at the selected string length in step 412. This can be accomplished using a lookup table or any other suitable means. By way of example, a two dimensional lookup table with firing fraction and string length as the indices works well.

The controller also identifies any matching sequence segments in adjacent firing fractions in the direction of the target firing fraction (415). In some implementations, the controller would only identify matching sequence segments in the immediately adjacent firing fraction in the direction of the target firing fraction. In others it might identify any and all matching sequence segments in the target firing fraction and any available intermediate firing fractions that are between the current firing fraction and the target firing fraction. The difference depends on the desired transition characteristics as described below. Again, look-up tables are well suited for this step. Although the process is described as having separate steps to identify the matching sequence segments for the purposes of explanation, it should be appreciated that a single lookup table or other simplified approaches can be used to identify the matching sequence segments.

In step 418 a determination is made as to whether any matches exist. If not, the string length may be decremented (421) and the steps 412-421 are repeated using progressively shorter string lengths until at least one match is identified. In most cases, a single iteration would be sufficient to insure a match is found. When a match occurs, a determination is then made at 424 as to whether the current phase of the firing sequence is the same as the matching sequence. For example, if the string length is 8 and the matching sequence segments can be represented in decimal form as 90 and 181, then a determination is made as to whether the preceding eight firing opportunities can also be represented as a 90 or 181. If so, a switch is made to the matching adjacent firing fraction and the next firing is dictated by the firing sequence associated with this new firing fraction in step 427. If the new firing fraction is the target firing fraction (as determined at 430) then the logic returns to 403 where it awaits the next firing fraction change request. If the new firing fraction is an intermediary firing fraction, then the logic returns to step 409 and the process is repeated to sequentially step through any necessary intermediate firing fractions until the desired firing fraction is obtained.

If in step 424, a determination is made that the current phase is not one of the matching sequences, then the next firing is directed in accordance with the current firing fraction sequence as indicated at 435. After that firing, the transition controller checks to see whether the new sequence phase has a matching sequence segment. This process is repeated until a match is found, at which point the logic transitions to 427 as previously described. The described process can then be repeated as long as the engine is operated in a skip fire mode.

Several of the embodiments described above are based on the concept of transitioning between firing fractions at locations where there are matching firing sequences between the current and target (or next) firing fractions. When a change is commanded, the controller can determine whether the current state of the engine is appropriate for changing the firing fraction to or towards a target firing fraction. If a sequence match occurs, the transition is made at that point. If there is no sequence match, a similar determination can be made at the next opportunity and so on until a sequence match is found. Once a sequence match is found, a transition occurs. If the transition is to the target firing fraction, the transition is completed and the skip fire controller continues operation at that firing faction until another change is requested. If the transition is to an intermediate firing fraction, then the process is repeated to determine when it is appropriate to transition to the following firing fraction. In this way, step-wise firing fraction changes may be made through intermediate firing fractions until the target firing fraction is reached.

The match determinations may be made as frequently as desired. For example, in some implementations, the match determinations are made on an engine cycle by engine cycle basis, while in others, they may be made on a firing opportunity by firing opportunity basis. In still other embodiments, the determinations may be made at other appropriate intervals or under other appropriate constraints.

When the determinations are made on an engine cycle by engine cycle basis, the controller determines the presence or absence of a match only once each full engine cycle (i.e., once every two rotations of the crankshaft in 4-stroke engines). Changes are then implemented only at a designated point in the engine cycle (e.g., beginning with the first firing decision associated with an engine cycle). In such an arrangement the controller would wait for a matching engine cycle to implement the change. A feature of this approach is that it tends to provide relatively slow transitions—particularly in circumstances where a long bit length is considered. For example, consider an 8-cylinder engine in which the sequence evaluated matches the cylinder count (i.e. 8-bits), which implies that the firing status of all of the cylinders is evaluated. As can be seen in FIG. 3, a transition from a firing fraction of 4/9 to a firing fraction of ½ can take as many as 8 engine cycles if the engine cycle state happens to be "42" at the time that a change request is first made (i.e., beginning at 42, the sequence continues 149, 74, 165, 82, 169, 84, 170, 85—with 170 being the first match on the eighth engine cycle). Of course, in other situations the transition may occur in the next engine cycle (e.g., if the engine cycle state happened to be state 170 at the time of the request.

If desired, such transitions can be speed up considerably by making the transition determinations on a firing opportunity by firing opportunity basis. Using the 4/9 to ½ transition in an 8-cylinder engine that considers 8 bits, the maximum wait for making a transition would be 8 firing opportunities (which correspond to one engine cycle).

In some embodiments, it may be desirable to require a "hold" for at least a minimum period at each step. The length of the hold may vary based on the design requirements of any particular system and they may vary based on the transitions being made. That is, a transition through a firing fraction of 4/9 could have a different minimum dwell time than a transition through a firing fraction of ½ and so on.

Any number of rules may be implemented to guide the transition between different firing fractions. For example, one potential constraint could be that the engine must be operated for a designated period during each intermediate step of the transition. The nature of the hold period can be widely varied, as for example: (i) a full engine cycle; a full firing sequence or some other designated period. Another constraint can be the maximum number of firing fractions that may be skipped in any single step. Such maximum skip rules may be simple (e.g., the most you can skip is two firing fractions); they may be based in part on the direction of the transition (e.g., to higher or to lower firing fractions; they may be based in part on engines speed; (e.g., at higher engine speeds larger skips are permitted); they may be based in part on the current firing fraction (i.e., the controller is allowed to move as many as two firing fractions higher and three firing fractions lower from a firing fraction of X, and to move as many as three firing fractions higher and four firing fractions lower from a firing fraction of Y, etc.); they may be based on specific operating conditions (e.g., larger skips may be permitted when the driver is aggressively accelerating or braking; or and/or various combinations of these and other rules may be implemented (e.g, the maximum skips may be based on combinations of engine speed, current firing fraction, direction of skip, current operating conditions, etc.).

Figure 8:
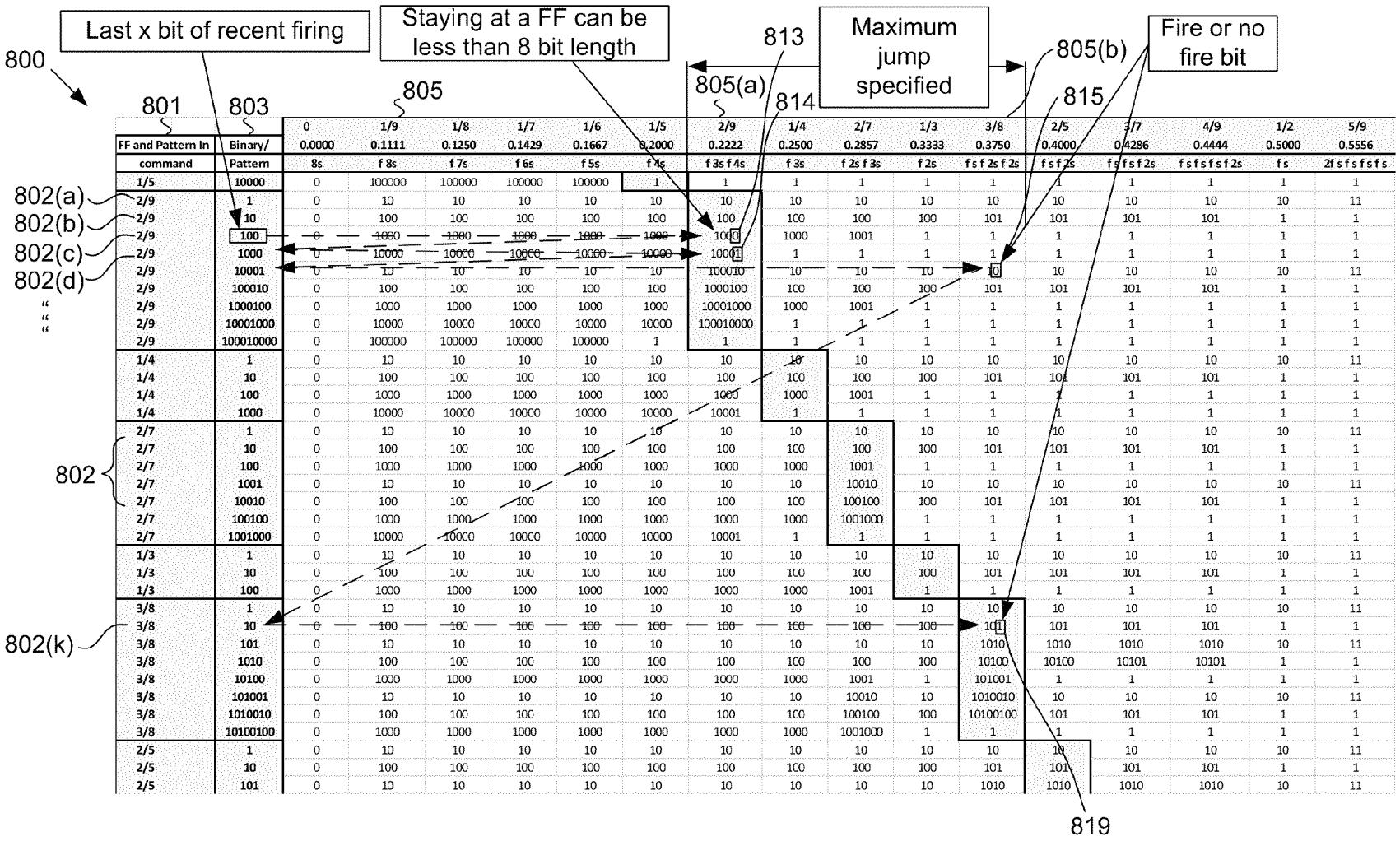
FIG. 8 is a transition table in accordance with another embodiment.

Referring next to FIG. 8 another embodiment that utilizes a different transition management approach will be described. In this embodiment a transition table 800 is provided that defines the transition to be made at any point in a firing sequence. FIG. 8 shows a small segment of the transition table 800. The transition table 800 is sometimes referred to herein as a "1-bit" table because it defines how a transition can be made at any point in any firing sequence.

The illustrated transition table has a first column 801 that indicates an initial firing fraction. Each firing fraction has a plurality of different rows 802, with each row corresponding to a unique stage in a recurring, most evenly spaced firing sequence that is associated with the firing fraction, with no accounting for the physical cylinder that is fired. The stages are represented in binary form for illustrative purpose in a second column 803.

To understand what is shown in column 803 consider the repeating, most evenly spaced, firing sequence that is dictated by a ⅔ firing fraction, which is a nine bit sequence "100010000". The first row 802(*a*) associated with the ⅔ firing fraction represents the first bit in the 100010000 sequence (underlined)—and is represented in column 803 as a "1" signifying that it is the first bit in the sequence. The second row 802(*b*) associated with the ⅔ firing fraction represents the second bit in the 100010000 sequence—and is represented in column 803 as "10" signifying that it is the second bit in the sequence. The third row 802(*c*) associated with the ⅔ firing fraction represents the third bit in the 10 0010000 sequence—and is represented in column 803 as "100" signifying that it is the third bit in the sequence. The fourth row 802(*d*) associated with the ⅔ firing fraction represents the fourth bit in the 100010000 sequence—and is represented in column 803 as "1000" signifying that it is the fourth bit in the sequence and the remaining bits (5-9) are represented sequentially in a similar manner. Each of the other firing fractions have similar sets of rows that represent each bit in their associated recurring sequences.

The table has a column 805 associated with each firing fraction that is supported by the skip fire controller. The table entries indicate the location in the firing sequence of the associated firing fraction column that would be appropriate for the next firing if the associated firing fraction (column) was requested at a time when the current state of the firing sequence corresponds to the associated row. To illustrate the use of the table, consider a situation where an engine is operating at a firing fraction of ⅔ and the current phase in the firing sequence is "100" corresponding to row 802(*c*). This suggests that the last two firing opportunities were skips. In normal ⅔ operation, the firing decision for the next firing opportunity should be another skip. The transition table entry 813 corresponding to the ⅔ firing fraction column 805(*a*), row 802(*a*) is "1000", with the final zero representing the "skip" firing decision for the next firing opportunity. Thus, the appropriate skip/fire decision for the "next" firing opportunity can be made by a simple table lookup using the current engine state as a first index (i.e. the row index) and the desired firing fraction as a second index (i.e., the column index).

In the stated example, transition table entry 813 (i.e. "1000") is the value returned from the lookup. It should be appreciated that the last bit of table entry 813 value "1000" indicates the firing decision (in this case a skip) and the full value "1000" indicates the phase of the ⅔ firing fraction sequence that the engine will be at once that firing decision is made. This phase is used as the current engine state for the following firing decision lookup.

Continuing operation at the ⅔ firing fraction, the following firing decision lookup reads the value in row 802(*d*) [corresponding to ⅔ state "1000"] at column 805(*a*) [corresponding to the commanded firing fraction for the next firing opportunity], which returns entry 814—"10001". The last bit of the value "10001" indicates that the next firing decision should be a "fire" as well as the appropriate phase for the following lookup. The table can continue to be traversed in this manner to provide the firing decisions as long as the engine continues to be operated at the ⅔ firing fraction.

If the skip fire controller determines that the firing fraction should change to a ⅜ firing fraction when the last firing decision state is represented by entry 814, (i.e., FF=⅔; phase="10001") then the same approach is used to determine the next firing decision. In such a case, the control algorithm returns table entry 815 which correspond to row 802(*e*) (i.e., current state FF=⅔; phase="10001") and column 805(*b*) (i.e., target FF=⅜). The returned value "10" indicates that the next firing decision should be a "skip" and indicates the appropriate phase in the ⅜ firing fraction sequence (row 802(*k*)) that should be used for the following lookup. When the next firing opportunity arises, the lookup row 802(*k*) is used to determine whether to skip or fire the next cylinder. Assuming that the firing fraction remains at 3;8, "101" which is the value of field 819 would be returned indicating that the next cylinder should be fired. The appropriate firing decisions can then be made using table 800 by repeating the same table lookup process.

The described table-based 1-bit transition approach can be used to dynamically make the firing decisions on a firing opportunity by firing opportunity basis in a manner that helps smooth transitions relative to conventional skip fire operation. An advantage of the approach is that can implement requested changes very quickly, although it can be susceptible to more vibration than filtered sigma delta approach described in some of the referenced applications (e.g., U.S. patent application Ser. No. 13/654,244).

It has been observed that large changes in firing fraction tend to be particularly susceptible to generating vibrations. Therefore, it will often be desirable to place constraints on the maximum firing fraction jumps that can be executed as explained earlier with respect to the previously described embodiments. When one or more intermediate firing fractions are used in a transition, it may also be desirable to require that the controller dwell at each intermediary stage for some designated period (e.g. 1 or a set number of engine cycles). As indicated above, such constraints do not need to be the same for all operating conditions. Rather, the constraints may be varied based on a variety of factors such as the current firing fraction, engine speed, direction of the change, nature of the change request, etc.

Although a specific transition table 800 and table navigation algorithm has been described, it should be appreciated that the information provided in the table can be represented in many other formats including various different table formats or through the use of different types of data structures. The column and row headers are for illustrative purposes to facilitate explanation of the approach and do not need to be literally incorporated into the table or other data structure.

One of the keys to the described approach is the fact that sequence phase information is used to determine the appropriate transitions between firing fraction. In particular, it is noted that the current sequence phase information is used in determining the phase at which a target firing sequence should be entered. It should be appreciated that this feature is common to the various described embodiments.

In the description above, a table was used to make the firing decisions both during steady state operation and during transitions. It other embodiments, transition tables can readily be used only to define transitions alone while other techniques are used dictate the firing sequence during continuous operation at a particular firing fraction (so long as current firing sequence phase information is available or derivable at the time of a desired transition).

Although only a few embodiments of the invention have been described in detail, it should be appreciated that the invention may be implemented in many other forms without departing from the spirit or scope of the invention. For example, although transition management has been described primarily in the context of a skip fire controller that favors a most even spacing of the firings, it should be appreciated that the same approach could be used for any given set of firing patterns that any particular skip fire controller may utilize. The invention is particularly useful in the context of skip fire controllers that are arranged to utilize a set of predetermined firing fractions, however again, that is not a requirement. Thus, although the examples are primarily based on a particular 8 cylinder engine having a particular set of available firing fractions, it should be appreciated that similar tables can be constructed for different engines and for engines that are operated using different types of skip fire control constraints or definitions. This includes engines having different numbers of cylinders; engines having different sets of available firing fractions, etc.

Although a few particular controller architectures and control methods have been described for illustrative purposes, it should be appreciated that the actual logic of the controller may be widely varied and that described functionalities may be combined, implemented in other ways, rearranged and generally altered in any way appropriate for a particular implementation.

The examples given above relate primarily to 4-stroke piston engines suitable for use in motor vehicles. However, it should be appreciated that the described transition management approaches are very well suited for use in virtually any type of internal combustion engine that is operated in a skip fire manner. These include engines for virtually any type of vehicle—including cars, trucks, boats, aircraft, motorcycles, scooters, etc.; for non-vehicular applications such as generators, lawn mowers, leaf blowers, models, etc.; and virtually any other application that utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles.

In the embodiments discussed above, it was assumed that all of the cylinders would be used or otherwise operated in the skip fire operational mode. However, that is not a requirement. If desired for a particular application, the firing control unit can readily be designed to utilize skip fire control on a subset of the available cylinders (working chambers). In view of the foregoing, it should be apparent that the present embodiments should be considered illustrative and not restrictive and the invention is not to be limited to the details given herein, but may be modified within the scope of the appended claims.

What is claimed is:

1. A method of managing a transition between a first operational firing fraction and a second operational firing fraction during operation of an engine in a skip fire operational mode, the first firing fraction having an associated first repeating firing sequence and the second firing fraction having an associated second repeating firing sequence, the method comprising:

identifying a firing sequence segment of a designated length that is shared by the first and second firing fractions, wherein the shared firing sequence segment is a set of individual working chamber firing decisions that is the same in the first and second repeating firing sequences, the first and second firing fractions being different; and transitioning from the first to the second firing fraction in conjunction with the execution of the shared firing sequence segment, whereby the firing fraction entering the shared firing sequence is the first firing fraction and the firing fraction exiting the shared sequence is the second firing fraction.

2. A method of managing a transition between firing fractions as recited in claim 1 wherein the designated length of the shared sequence segment is at least four sequential firing decisions.

3. A method of managing a transition between firing fractions as recited in claim 2 wherein the designated length of the shared sequence segment is at least eight sequential firing decisions.

4. A method of managing a transition between firing fractions as recited in claim 1 wherein:

the first and second firing fractions each have an associated repeating, most evenly spaced firing pattern that includes a set of available firing sequence segments of a designated length of at least four firing decisions;

the set of available firing sequence segments for the first and second firing fractions are not coextensive;

at least one of the available firing sequence segments is common between the first and second firing fractions; and the transition from the first to the second firing fraction is constrained to occur in conjunction with the execution of a selected one of the shared firing sequence segments.

5. A method as recited in claim 1 wherein transitions between different firing fractions are constrained to jump no more than a designated maximum number of firing fractions during any single step of a transition.

6. A method as recited in claim 5 wherein the designated maximum number of firing fractions that may be jumped in any single step of a transition varies as a function of engine speed.

7. A method as recited in claim 5 wherein the designated maximum number of firing fractions that may be jumped in any single step of a transition varies as a function of the first operational firing fraction.

8. A method as recited in claim 1 wherein:

transitions between different firing fractions are sometimes implemented in a plurality of steps including at least one intermediate firing fraction; and wherein each intermediate firing fraction is executed for at least one complete engine cycle.

9. A method as recited in claim 1 wherein the repeating firing sequences for the first and second firing fractions are both most evenly spaced firing sequences for their respective firing fractions.

10. Computer code embodied in a computer readable media suitable for executing the methods set forth in claim 1.

11. A controller arranged to direct operation of an engine in a skip fire mode, wherein the controller is arranged to manage transitions between operational skip fire firing fractions using the technique recited in claim 1.

12. A method of managing a transition between a first operational firing sequence representative of a first firing fraction and a second operational firing sequence representative of a second firing fraction during operation of an engine in a skip fire operational mode, the first and second firing fractions being different, the method comprising accessing a data structure using a current firing fraction phase as a first index and a target firing fraction as a second index, to determine a phase of the second firing sequence to enter at the transition.

13. A method as recited in claim 12 wherein the table entries provide a firing decision indicative of whether or not to fire the next working chamber and a representation of a phase to be utilized as the current firing fraction phase when making a following firing decision.

14. A method as recited in claim 12 wherein the data structure is a lookup table.

15. A method as recited in claim 12 wherein transitions between different firing fractions are sometimes implemented in a plurality of steps, and wherein such transitions are constrained to jump no more than a designated maximum number of firing fractions during any single step of the transition.

16. A method as recited in claim 15 wherein the designated maximum number of firing fractions that may be jumped in any single step of a transition varies as a function of at least one of:

engine speed;

the first operational firing fraction;

the direction of the transition; and selected operating conditions at the time of the transition.

17. A controller arranged to direct operation of an engine in a skip fire mode, wherein the controller is arranged to manage transitions between operational skip fire firing fractions using the technique recited in claim 12.

18. A method of managing a transition between available firing fractions during operation of an engine in a skip fire mode in which the engine may be operated in any of a multiplicity of available firing fractions, the method comprising:

in response to the reception of a request to change an operational skip fire firing fraction from a first firing fraction to a second firing fraction that is separated from the first firing fraction by at least one intermediate available firing fraction, sequentially transitioning from the first firing fraction to the second firing fraction in a step-wise manner through each intermediate available firing fraction.

19. A method as recited in claim 18 wherein each intermediate firing fraction is executed for at least one complete engine cycle.

20. A method as recited in claim 19 wherein each intermediate firing fraction is executed for a plurality of complete engine cycle.

21. A method of managing a transition between a first operational firing fraction and a second operational firing fraction during operation of an engine in a skip fire operational mode, the method comprising:

transitioning from the first firing fraction to an intermediate firing fraction between the first and second operational firing fractions that is not a normal operational firing fraction; and subsequently transitioning from the intermediate firing fraction to the second firing fraction; and wherein the first and second firing fractions each have an associated firing pattern which includes a fixed set of available firing sequence segments of a designated length of at least four firing decisions;

wherein the set of available firing sequence segments for the first and second firing fractions are not coextensive; and wherein the intermediate firing fraction has a set of available firing sequence segments that includes all of the firing sequence segments for the first and second firing fractions.

* * * * *